US007451607B2

(12) United States Patent
Behr

(10) Patent No.: US 7,451,607 B2
(45) Date of Patent: Nov. 18, 2008

(54) METHOD OF CONTROL FOR A REFRIGERATED MERCHANDISER

(75) Inventor: John Arthur Behr, Augusta, MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 12/039,853

(22) Filed: Feb. 29, 2008

(65) Prior Publication Data

US 2008/0141690 A1 Jun. 19, 2008

Related U.S. Application Data

(62) Division of application No. 11/176,072, filed on Jul. 7, 2005, now Pat. No. 7,367,198.

(51) Int. Cl.
*A47F 3/04* (2006.01)

(52) U.S. Cl. ..... 62/80; 62/155; 62/256

(58) Field of Classification Search ..... 62/80, 62/151, 155–156, 234, 246–256
See application file for complete search history.

(56) References Cited

U.S. PATENT DOCUMENTS

| | | | | |
|---|---|---|---|---|
| 2,531,136 | A | 11/1950 | Kurtz | |
| 3,381,488 | A | 5/1968 | Lewis | |
| 3,691,782 | A | 9/1972 | Holzer | |
| 4,662,184 | A | 5/1987 | Pohl et al. | |
| 4,887,436 | A | 12/1989 | Enomoto et al. | |
| 4,964,281 | A | 10/1990 | Tanaka | |
| 4,993,233 | A * | 2/1991 | Borton et al. | 62/155 |
| 5,187,941 | A | 2/1993 | Tershak et al. | |
| 5,317,881 | A | 6/1994 | Colvin | |
| 5,379,608 | A | 1/1995 | Ishimaru et al. | |
| 5,502,979 | A | 4/1996 | Renard | |
| 5,647,220 | A | 7/1997 | Kawaguchi et al. | |
| 5,809,789 | A | 9/1998 | Baker et al. | |
| RE37,630 | E | 4/2002 | Behr | |
| 6,411,916 | B1 | 6/2002 | Pellerin | |
| 6,502,409 | B1 | 1/2003 | Gatling et al. | |
| 6,591,622 | B1 | 7/2003 | Gherman et al. | |
| 6,609,078 | B2 | 8/2003 | Starling et al. | |
| 6,619,052 | B1 | 9/2003 | Nash, Jr. | |
| 6,949,021 | B2 | 9/2005 | Ichishi et al. | |
| 2003/0024256 | A1 | 2/2003 | Hanson | |

FOREIGN PATENT DOCUMENTS

| | | | |
|---|---|---|---|
| GB | 2167579 | A | 5/1986 |

* cited by examiner

*Primary Examiner*—William E Tapolcai
(74) *Attorney, Agent, or Firm*—Michael Best & Friedrich LLP

(57) ABSTRACT

A method of controlling a refrigerated merchandiser. The method includes providing a case that defines a product display area and an air passage that has an inlet and an outlet, positioning an evaporator in the air passage to refrigerate the air, positioning a fan in the air passage to move the air through the passage, and logging a first temperature value during frost-free operation of the evaporator. The method also includes logging a second temperature value during frosted operation of the evaporator, calculating a difference of the first and second temperature values, and defrosting the evaporator when the difference exceeds a pre-determined value. Each of the first temperature value and the second temperature value is independently associated with at least one of the air entering the inlet of the air passage, the air exiting the outlet of the air passage, and saturated evaporator temperature.

9 Claims, 6 Drawing Sheets

METHOD OF CONTROL FOR A REFRIGERATED MERCHANDISER

RELATED APPLICATIONS

This patent application is a divisional application of U.S. patent application Ser. No. 11/176,072, filed Jul. 7, 2005, entitled "METHOD OF CONTROL FOR A REFRIGERATED MERCHANDISER," the entire contents of which are hereby incorporated by reference.

FIELD OF THE INVENTION

This invention relates generally to merchandisers, and more particularly to refrigerated merchandisers.

BACKGROUND OF THE INVENTION

In conventional practice, supermarkets and convenience stores are equipped with refrigerated merchandisers, which may be open or provided with doors, for presenting refrigerated products like fresh food or beverages to customers while maintaining the fresh food and beverages in a refrigerated environment. Typically, cold, moisture-bearing air is provided to a product display area of the merchandiser by passing an airflow over the heat exchange surface of an evaporator coil containing a suitable refrigerant. As the airflow passes through the evaporator coil, heat is transferred from the airflow to the refrigerant, which causes the refrigerant to evaporate. As a result, the temperature of the air passing through the evaporator is lowered for introduction into the product display area of the merchandiser.

Typically, the temperature of the air discharged into the product display area is controlled to maintain a pre-determined set point. Such a set point is typically recommended by the manufacturer of the refrigerated merchandiser, and is typically based upon data accumulated during experimental trials.

SUMMARY OF THE INVENTION

In one construction, the present invention provides a method of controlling a refrigerated merchandiser. The method includes providing a case defining a product display area and an air passage having an inlet that receives air from the product display area and an outlet that delivers air to the product display area. The method also includes positioning an evaporator in the air passage to refrigerate the air and positioning a fan in the air passage to move the air through the passage. The method further includes logging a first temperature value during frost-free operation of the evaporator, the first temperature value associated with at least one of the air entering the inlet of the air passage, the air exiting the outlet of the air passage, and saturated evaporator temperature, and logging a second temperature value during frosted operation of the evaporator, the second temperature value associated with at least one of the air entering the inlet of the air passage, the air exiting the outlet of the air passage, and saturated evaporator temperature. The method also includes calculating a difference of the first and second temperature values and defrosting the evaporator when the difference exceeds a predetermined value.

Other features and aspects of the present invention will become apparent to those skilled in the art upon review of the following detailed description, claims and drawings.

DETAILED DESCRIPTION

Figure 1:
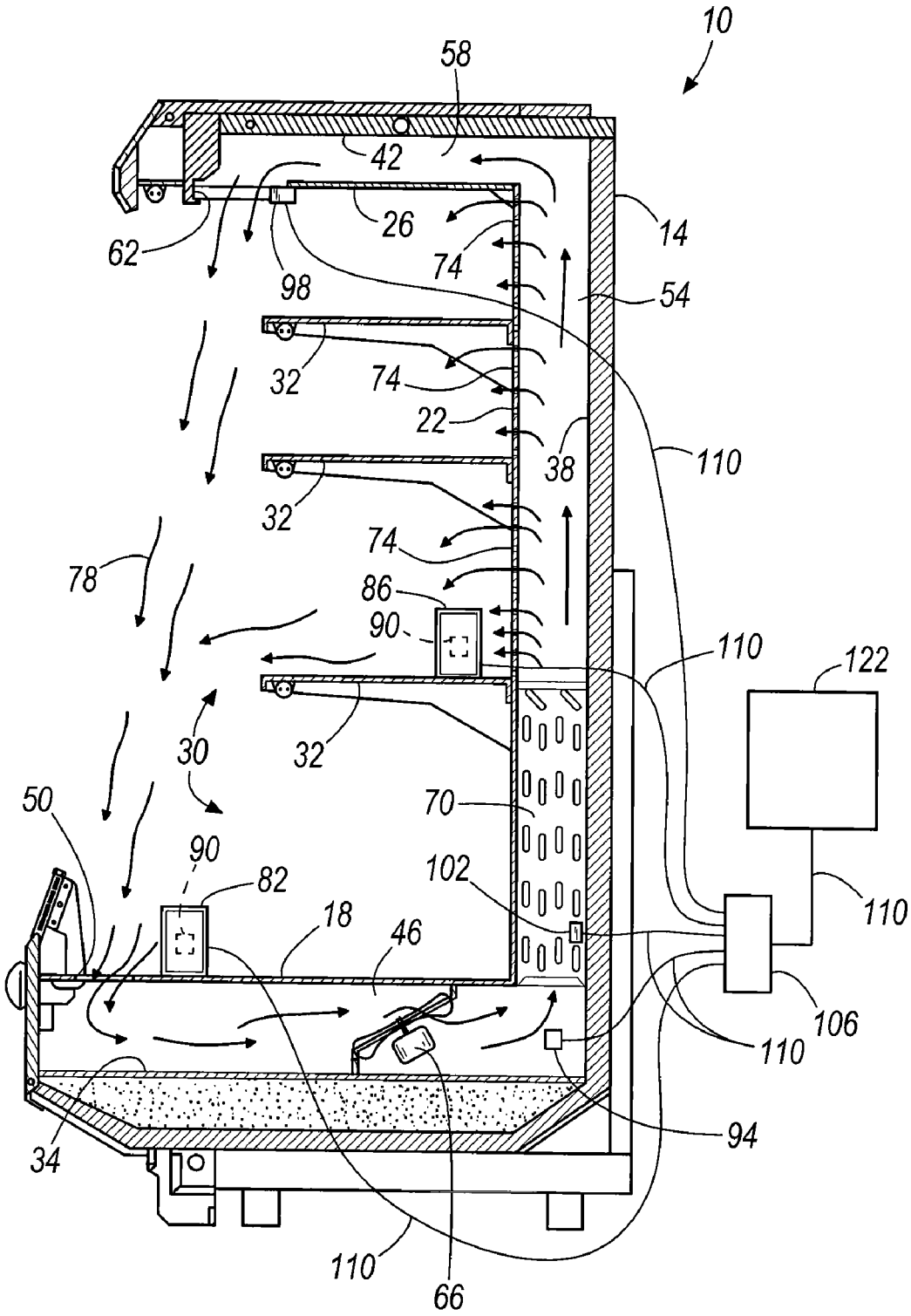
FIG. 1 is a cross-sectional view of a refrigerated merchandiser of the present invention incorporating multiple wired product simulators positioned in a product display area of the merchandiser.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

Figure 2:
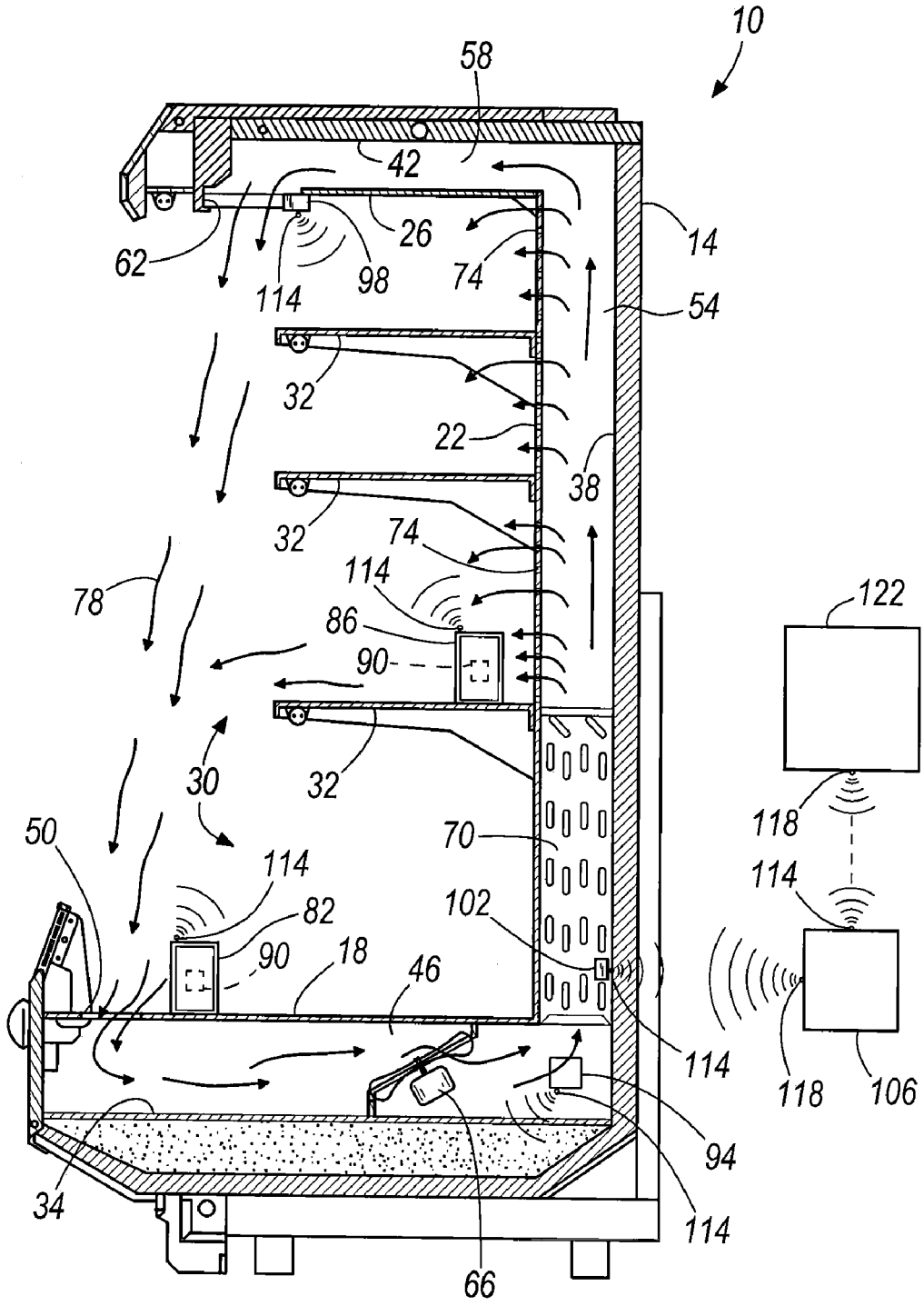
FIG. 2 is a cross-sectional view of the refrigerated merchandiser of FIG. 1, incorporating multiple wireless product simulators positioned in the product display area of the merchandiser.

A refrigerated merchandiser 10 of the present invention is shown in FIGS. 1 and 2. With reference to FIG. 1, the merchandiser 10 includes a case 14 generally defining an interior bottom wall or shelf 18, an interior rear wall 22, and an interior top wall 26. The area bounded by the interior bottom wall 18, interior rear wall 22, and the interior top wall 26 defines a product display area 30, in which the refrigerated products (e.g., fresh food and/or beverages) are stored on one or more shelves 32. The case 14 includes an open front face to allow customers access to the refrigerated products stored in the case 14.

The merchandiser 10 may comprise a medium-temperature merchandiser, in which the food product temperature in the display area 30 is maintained within a standard temperature range of 28° F. to 41° F. Such merchandisers 10 may include, for example, meat merchandisers, deli and dairy merchandisers, and produce merchandisers. Alternatively, the merchandiser 10 may comprise a low-temperature merchandiser, in which the food product temperature in the display area 30 is maintained at a temperature below 28° F. Such a merchandiser 10 may include, for example, a frozen food merchandiser.

The merchandiser 10 may be comprised of two interconnected modules (not shown). Each module may include a case 14 having its own set of refrigeration components (e.g., an evaporator 70 and one or more fans 66). The separate modules may be interconnected by decorative or structural moldings to give the appearance of a single merchandiser 10. In addition, the separate modules may be interconnected to give the appearance of a single product display area 30. Alternatively, the merchandiser 10 may comprise a single module, or the merchandiser 10 may comprise more than two interconnected modules. For purposes of description only, a single merchandiser module is described herein.

The case 14 generally defines an exterior bottom wall 34 adjacent the interior bottom shelf 18, an exterior rear wall 38 adjacent the interior rear wall 22, and an exterior top wall 42 adjacent the interior top wall 26. A lower flue 46 is defined between the interior bottom shelf 18 and the exterior bottom wall 34 to allow for substantially horizontal airflow throughout the lower flue 46. The interior bottom shelf 18 includes an opening 50 to communicate with the lower flue 46 to allow surrounding air to be drawn into the lower flue 46 from the product display area 30. A rear flue 54 is defined between the interior and exterior rear walls 22, 38 and is fluidly connected with and adjacent to the lower flue 46. The rear flue 54 allows for substantially vertical airflow throughout the rear flue 54. An upper flue 58 is defined between the interior and exterior top walls 26, 42 and is fluidly connected with and adjacent to the rear flue 54. The upper flue 58 allows for substantially horizontal airflow throughout the upper flue 58. The interior top wall 26 includes an opening 62 to communicate with the upper flue 58 to allow airflow in the upper flue 58 to be discharged from the upper flue 58 and into the product display area 30. When combined, the lower flue 46, the rear flue 54, and the upper flue 58 comprise an air passage separate from the product display area 30, in which the opening 50 provides an inlet to the air passage and the opening 62 provides an outlet for the air passage.

The refrigerated merchandiser 10 also includes some components of a refrigeration system (not entirely shown) therein. One or more fans 66 are located within the lower flue 46 toward the back of the case 14 to generate an airflow through the lower, rear, and upper flues 46, 54, 58. An evaporator coil or evaporator 70 is located within the rear flue 54 toward the bottom of the case 14. The evaporator 70 is positioned downstream of the fans 66 such that the airflow generated by the fans 66 passes through the evaporator 70. The refrigeration system may also include other components (not shown), such as one or more compressors, one or more condensers, a receiver, and one or more expansion valves, all of which may be remotely located from the refrigerated merchandiser 10.

With continued reference to FIG. 1, the interior rear wall 22 includes a plurality of apertures 74. The apertures 74 fluidly connect the product display area 30 and the rear flue 54. The apertures 74 allow some of the refrigerated air in the rear flue 54 to exit the rear flue 54 and enter the product display area 30. Products located in the product display area 30 may then be cooled by the refrigerated air.

A portion of the refrigerated air is routed vertically through the rear flue 54, and horizontally through the upper flue 58 before being discharged from the upper flue 58 via the opening 62 in the interior top wall 26. After being discharged from the opening 62 in the interior top wall 26, the refrigerated air moves downwardly along the open front face of the refrigerated merchandiser 10 before being drawn back into the opening 50 in the interior bottom wall 18 for re-use by the fans 66. This portion of the refrigerated airflow is known in the art as an air curtain 78. The air curtain 78, among other things, helps maintain the air temperature in the product display area 30 within a temperature range determined by the products in the merchandiser 10.

With continued reference to FIG. 1, a first product simulator 82 is positioned on the interior bottom shelf 18 adjacent the opening 50 or adjacent the inlet to the air passage. In this position, the first product simulator 82 receives refrigerated air that is returning to the lower flue 46, which is typically the "warmest" refrigerated air in the case 14 because it has absorbed heat from products in the product display area 30 and has undergone some mixing with the ambient air outside the product display area 30. In other words, products positioned on the interior bottom shelf 18 adjacent the opening 50 are located in the "highest temperature zone" of the product display area 30.

Likewise, a second product simulator 86 is positioned on a shelf 32 adjacent the interior rear wall 22. In this position, the second product simulator 86 receives refrigerated air discharged from the rear flue 54, which is typically the "coolest" refrigerated air in the case 14 because it has not yet absorbed any heat from products in the product display area 30. In other words, products positioned adjacent the interior rear wall 22 on the shelves 32 are located in the "lowest temperature zone" of the product display area 30.

The first and second product simulators 82, 86 can each include a thermal mass (not shown) to approximate the thermal characteristics of products typically positioned in the respective highest and lowest temperature zones. The first and second product simulators 82, 86 can also each include a temperature probe or sensor 90 to detect the temperatures of the respective thermal masses, which approximate the actual temperature of the products positioned in the respective highest and lowest temperature zones. The first and second product simulators 82, 86 can be similar to those disclosed in U.S. Pat. No. 6,502,409, the entire contents of which is incorporated herein by reference.

Other temperature sensors can be incorporated into the refrigerated merchandiser 10. With continued reference to FIG. 1, an inlet temperature sensor 94 is positioned in the lower flue 46 of the air passage to detect the temperature of the refrigerated air returning to the lower flue 46. In the illustrated construction, the inlet temperature sensor 94 is positioned in the lower flue 46 downstream of the fan 66. However, in alternate constructions, the inlet temperature sensor 94 may be positioned anywhere in the lower flue 46. In addition, an outlet temperature sensor 98 is positioned in the upper flue 58 of the air passage to detect the temperature of the refrigerated air discharged from the upper flue 58. In the illustrated construction, the outlet temperature sensor 98 is positioned adjacent the opening 62 or adjacent the outlet to the air passage. However, in alternate constructions, the outlet temperature sensor 98 may be positioned anywhere in the upper flue 58. Further, a saturated evaporator temperature sensor 102 is tube-mounted to the evaporator 70 to detect the saturated evaporator temperature. An ambient temperature sensor (not shown) can also be incorporated into the refrigerated merchandiser 10 to detect the store ambient temperature.

The product simulators 82, 86 and the temperature sensors 94, 98, 102 all communicate with a controller 106, which can be incorporated into the refrigerated merchandiser 10 or positioned remotely from the merchandiser 10. The product simulators 82, 86 output to the controller 106 respective first and second signals representative of the temperatures of products positioned in the highest and lowest temperature zones, respectively. Similarly, the inlet temperature sensor 94, outlet temperature sensor 98, and saturated evaporator temperature sensor 102 output to the controller 106 an inlet temperature signal, an outlet temperature signal, and a saturated evaporator temperature signal, respectively, representative of the inlet temperature of the refrigerated air, the outlet temperature of the refrigerated air, and the saturated evaporator temperature. As shown in FIG. 1, the signals are transmitted to the controller 106 via a plurality of wires 110. Alternatively, as shown in FIG. 2, each product simulator 82, 86 and temperature sensor 94, 98, 102 can include a wireless transmitter 114 and the controller 106 can include a wireless receiver 118 to transmit the signals wirelessly.

With reference to FIG. 1, a computer 122 can be used to interface with the controller 106 to modify the settings of the controller 106. Like the controller 106, the computer 122 can be incorporated into the merchandiser 10 or positioned remotely from the merchandiser 10. The computer 122 and controller 106 can communicate using wires 110, or the computer 122 and controller 106 can communicate wirelessly, as shown in FIG. 2. Alternatively, a computer separate from the controller 106 may not be required.

The combination of the product simulators 82, 86, temperature sensors 94, 98, 102, and the controller 106 allows the merchandiser 10 to utilize a control scheme that adapts the merchandiser 10 to its environment. More particularly, the controller 106 can interface with the product simulators 82, 86 and the refrigeration components of the merchandiser 10 to ensure that the temperature of each product simulator 82, 86, and thus the temperature of the actual products positioned in the highest and lowest temperature zones, are maintained within a pre-determined temperature range (e.g., between 32° F. and 41° F. for a medium-temperature merchandiser).

The control scheme programmed into the controller 106 can include a "fast" portion which is responsible for maintaining the outlet temperature of refrigerated air discharged from the upper flue 58 at a desired set point. Corrections to maintain the outlet temperature can be made about every few seconds of operation of the merchandiser 10. More particularly, corrections to maintain the outlet temperature can be made about every 1 to 3 seconds of operation of the merchandiser 10. Alternatively, corrections to maintain the outlet temperature can be made more or less frequently than about every 1 to 3 seconds of operation of the merchandiser 10.

To make corrections to the outlet temperature, the controller 106 receives the outlet temperature signal from the outlet temperature sensor 98, and compares the "actual" outlet temperature associated with the outlet temperature signal with the pre-determined outlet temperature set point. If, for example, the actual outlet temperature is greater than the outlet temperature set point, the controller 106 can manipulate the refrigeration components of the merchandiser 10 to provide "more" refrigeration to further cool the air in the rear and upper flues 54, 58. Likewise, if the actual outlet temperature is less than the outlet temperature set point, the controller 106 can manipulate the refrigeration components of the merchandiser 10 to provide "less" refrigeration to conserve energy. Although not shown in either of FIG. 1 or 2, the controller 106 can interface with, for example, a liquid solenoid valve (not shown) to control the flow of refrigerant through the evaporator 70 to provide more or less refrigeration to the product display area 30. Alternatively, the controller 106 can interface with a variable speed compressor, an electronic expansion valve ("EEV"), or an electronic evaporator pressure regulating ("EEPR") valve (not shown) to provide more or less refrigeration to the product display area 30. Further, variable-speed fans 66 can be used to increase the flow of the refrigerated air through the rear and upper flues 54, 58, effectively providing more or less refrigeration to the product display area 30.

The control scheme programmed into the controller 106 can also include a "slow" portion which is responsible for periodically adjusting the outlet temperature set point. Adjustments to the outlet temperature set point can be made about every few hours of operation of the merchandiser 10. More particularly, adjustments to the outlet temperature set point can be made about every 1 to 2 hours of operation of the merchandiser 10. Alternatively, adjustments to the outlet temperature set point can be made more or less frequently than about every 1 to 2 hours of operation of the merchandiser 10.

Figure 3:
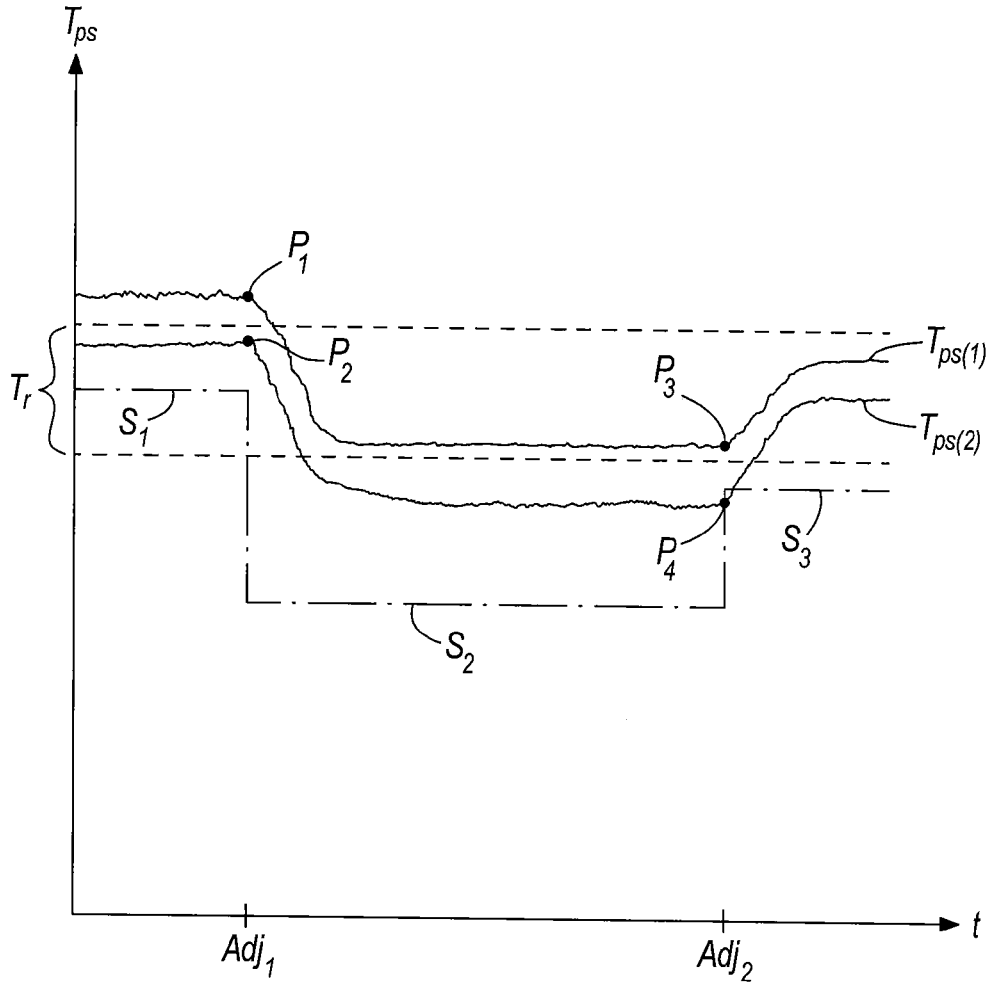
FIG. 3 is a graph illustrating a method of control for the refrigerated merchandiser of FIG. 1.

Adjusting the outlet temperature set point can be a desirable feature of the merchandiser 10 because it allows the merchandiser 10 to make corrections for outside factors influencing the temperature of the products in the product display area 30. For example, in an instance when the ambient temperature in a retail store is unusually warm, drafts of the warm air may enter the product display area 30 and warm-up the products to a temperature higher than their pre-determined acceptable temperature range. Such a scenario is illustrated in FIG. 3. FIG. 3 illustrates a graph comparing the temperatures of the product simulators 82, 86 versus time. Line ("$T_{ps(1)}$") represents the temperature of the first product simulator 82, while line ("$T_{ps(2)}$") represents the temperature of the second product simulator 86. The time axis ("t") is situated along the X-axis of the graph, and includes two occurrences of adjusting the outlet temperature set point. The period of time between adjustments represents about every 1-2 hours of operation of the merchandiser 10, as discussed above. The product simulator temperature axis ("$T_{ps}$") is situated along the Y-axis of the graph. An example pre-determined acceptable temperature range ("$T_r$") for products in the product display area 30 is also shown.

Before the first adjustment ("$Adj_1$"), the outlet temperature set point (shown as line $S_1$) may initially be in the middle of temperature range $T_r$. However, for example, due to the outside factors discussed above, the actual temperature of the first product simulator 82 (indicated by line $T_{ps(1)}$) and the products in the highest temperature zone of the product display area 30 may be higher than the temperature range $T_r$. Points $P_1$ and $P_2$ indicate the temperatures of the first and second product simulators 82, 86, respectively, at the end of one 1-2 hour time period between adjustments. To make an adjustment to the outlet temperature set point, the controller 106 receives the first signal from the first product simulator 82 and the second signal from the second product simulator 86, and compares the "actual" product temperatures associated with the first and second signals with the pre-determined temperature range $T_r$. If one of the actual product temperatures is outside of the temperature range $T_r$, the controller 106 can make an adjustment to the outlet temperature set point to bring the actual product temperature back inside the temperature range $T_r$.

In the example illustrated in FIG. 3, the outlet temperature set point is lowered from $S_1$ to $S_2$ in an effort to lower the actual temperature of the first product simulator 82 and the actual temperature of other products situated in the highest temperature zone. For purposes of example only, the lowered outlet temperature set point $S_2$ may be too large of a change and cause the actual temperature of the second product simulator 86 (indicated by line $T_{ps(2)}$) to drop below the temperature range $T_r$. Then, at the second adjustment ("$Adj_2$"), the controller 106 can again receive the signals from the product simulators 82, 86 at points $P_3$ and $P_4$, and raise the outlet temperature set point from $S_2$ to $S_3$ in an effort to conserve energy and bring both temperature lines $T_{ps(1)}$ and $T_{ps(2)}$ within temperature range $T_r$. If, when the time comes to make the third adjustment, the actual temperatures of the product simulators 82, 86 are within the temperature range $T_r$, then no adjustment to the outlet temperature set point may be made.

Figure 4:
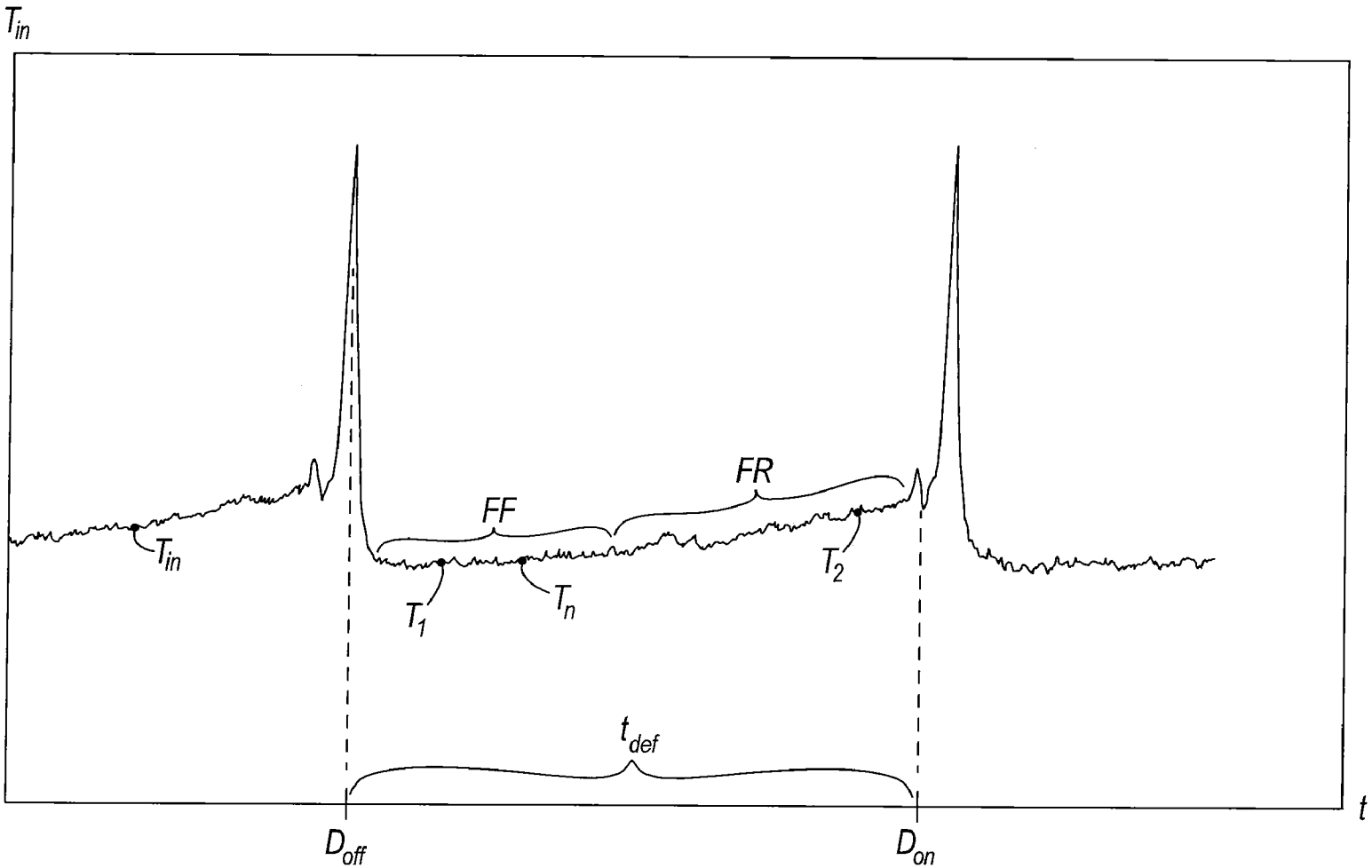
FIG. 4 is a graph illustrating another method of control for the refrigerated merchandiser of FIG. 1.

The control scheme programmed into the controller 106 can further include a "slowest" portion which is responsible for adjusting the defrost schedule of the merchandiser 10. Adjustments to the defrost schedule can be made about every 6 to 24 hours of operation of the merchandiser 10. Alternatively, adjustments to the defrost schedule can be made more or less frequently than about every 6 to 24 hours of operation of the merchandiser 10. Adjusting the defrost schedule can be a desirable feature of the merchandiser 10 because extending the time period between defrost cycles, when temperature conditions in the product display area 30 permit, can lessen the shock on the products in the product display area 30. In other words, subjecting the products to repeated display case defrost cycles can damage the products. Such a scenario is illustrated in FIG. 4. FIG. 4 illustrates a graph comparing, for example, the inlet temperature of the air returning to the lower flue 46 versus time. The time axis ("t") is situated along the X-axis of the graph, and includes a first mark ("$D_{off}$") indicating the end of a first defrost cycle, and a second mark ("$D_{on}$") indicating the beginning of a second defrost cycle. The period of time ("$t_{def}$") between the marks represents about every 6-24 hours of operation of the merchandiser 10 between defrost cycles, as discussed above. The temperature axis ("T") is situated along the Y-axis of the graph, and line ("$T_{in}$") represents the inlet temperature of the air returning to the lower flue 46.

To make an adjustment to the defrost schedule, or an adjustment of the time $t_{def}$ between defrost cycles, the controller 106 logs a first temperature value ("$T_1$") during "frost-free" operation of the evaporator 70, and a second temperature value ("$T_2$") during "frosted" operation of the evaporator 70. The evaporator 70 may operate at its optimal efficiency (i.e., without any built-up frost) for up to about one to three hours after a defrost cycle. Such frost-free operation is indicated by region ("FF") in FIG. 4. After frost begins to build-up on the evaporator 70, the evaporator 70 may operate at less than its optimal efficiency. Such frosted operation is indicated by region ("FR") in FIG. 4.

The controller 106 may log the first temperature value $T_1$, between about one to three hours after a defrost cycle, such that the first temperature value $T_1$ is representative of the evaporator 70 operating at its optimal efficiency (i.e., without built-up frost). After the first temperature value $T_1$ is logged, the controller 106 may be programmed to continuously monitor or log at discrete time intervals the value of the inlet temperature of the air returning to the lower flue 46 (represented by "$T_n$"). For each subsequent time interval, the controller 106 may be programmed to calculate the difference between temperature value $T_n$ and the first temperature value $T_1$. If the difference is larger than some pre-determined value, and a defrost cycle has not yet begun (i.e., if $T_n=T_2$), then the controller 106 can decrease the time $t_{def}$ between defrost cycles to ensure that built-up frost and ice are adequately removed from the evaporator 70. However, if the calculated difference is less than the pre-determined value at the beginning of a scheduled defrost cycle (i.e., at $D_{on}$), then the controller 106 can increase the time $t_{def}$ between defrost cycles to lessen shock on the products in the product display area 30.

The controller 106 may also be configured to activate a defrost cycle when the calculated difference exceeds the pre-determined value. With reference to FIG. 4, the controller 106 may log the first temperature value $T_1$ in the frost-free operating region FF of the evaporator 70 and the second temperature value $T_2$ in the frosted operating region FR of the evaporator 70. The controller 106 may calculate the difference between the first and second temperature values $T_1$, $T_2$ and compare the calculated difference ($T_2-T_1$) to the pre-determined value (e.g., two degrees). If the calculated difference ($T_2-T_1$) is greater than the pre-determined value, then the controller 106 may initiate a defrost cycle. Likewise, if the calculated difference ($T_2-T_1$) is less than the pre-determined value, then the controller 106 may continue monitoring or logging the inlet temperature $T_n$ until the calculated difference ($T_2-T_1$) exceeds the pre-determined value.

Figure 5:
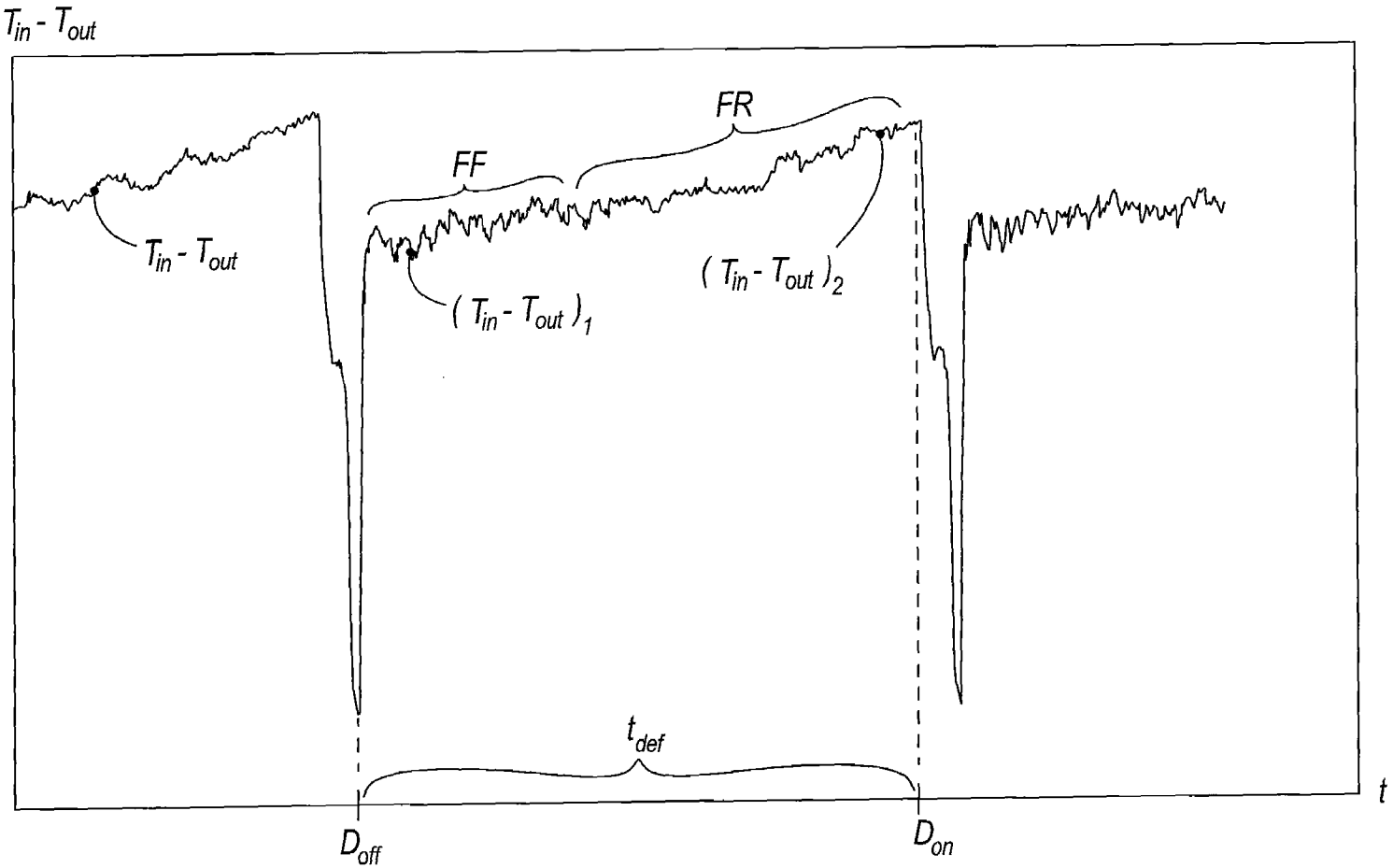
FIG. 5 is a graph illustrating yet another method of control for the refrigerated merchandiser of FIG. 1.

Alternatively, rather than logging the inlet temperature $T_n$ of the air returning to the lower flue 46, the controller 106 may continuously monitor or log the difference between the outlet temperature ("$T_{out}$") of the air discharged from the upper flue 58 and the inlet temperature $T_{in}$ of the air returning to the lower flue 46. FIG. 5 illustrates a graph of line ($T_{in}-T_{out}$), which is representative of the difference between the outlet temperature $T_{out}$ of the air discharged from the upper flue 58 and the inlet temperature $T_{in}$ of the air returning to the lower flue 46. As the time $D_{on}$ to begin the second scheduled defrost cycle approaches, the difference between the temperatures $T_{in}$ and $T_{out}$ increases as a result of frost accumulating on the evaporator 70. Specifically, built-up frost on the evaporator 70 reduces the velocity of the air moving through the evaporator 70, therefore decreasing the effectiveness of the air curtain 78 and increasing the inlet temperature $T_{in}$ of the air returning to the lower flue 46. Using a similar method as described above, the controller 106 may calculate the difference between $(T_{in}-T_{out})_2$ and $(T_{in}-T_{out})_1$ to determine whether the defrost schedule should be adjusted or whether a defrost cycle should be initiated.

Figure 6:
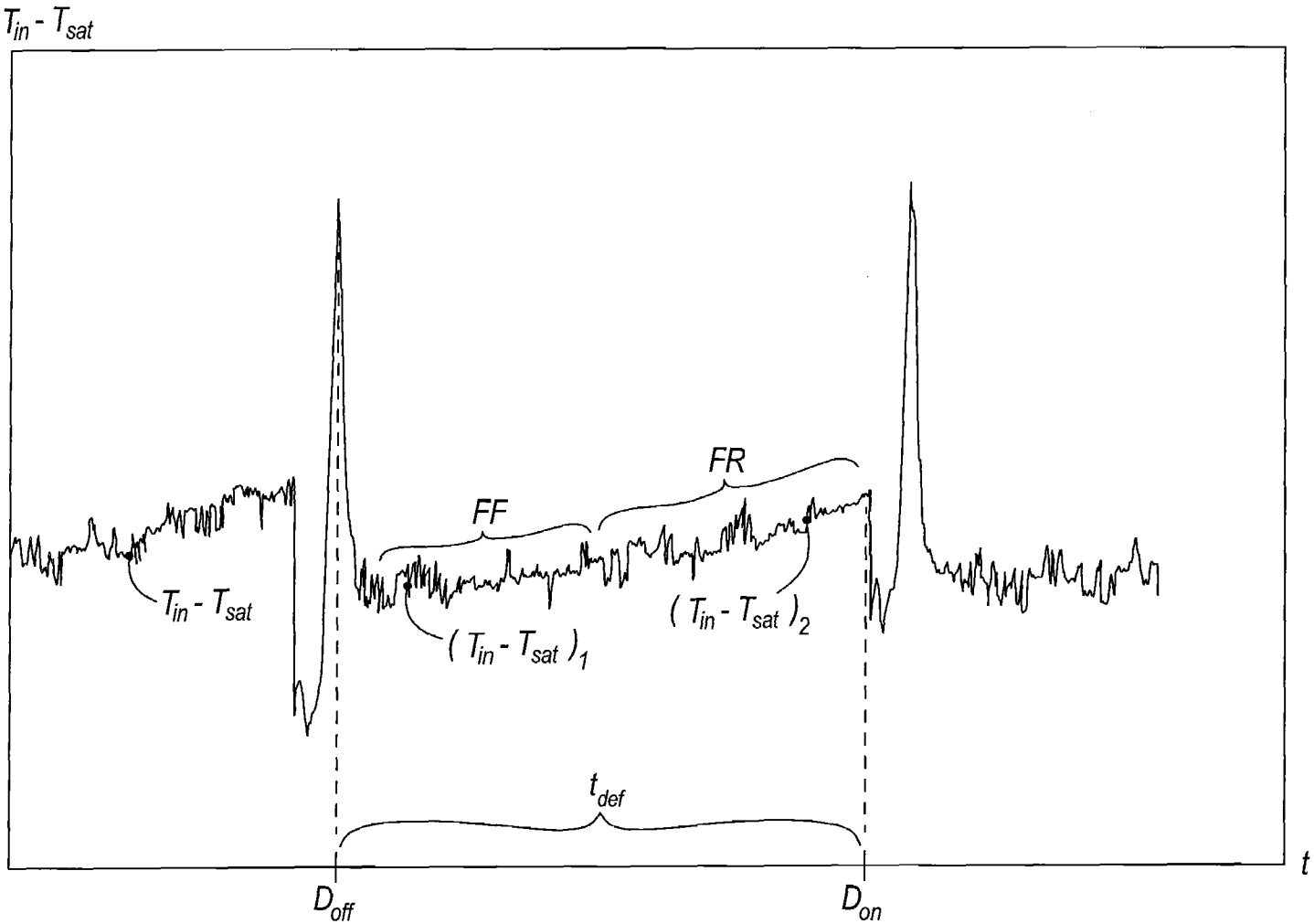
FIG. 6 is a graph illustrating another method of control for the refrigerated merchandiser of FIG. 1.

In addition, the controller 106 may continuously monitor or log the difference between the saturated evaporator temperature ("$T_{sat}$") and the inlet temperature $T_{in}$ of the air returning to the lower flue 46 to determine whether the defrost schedule should be adjusted or whether a defrost cycle should be initiated, using a similar method as described above. FIG. 6 illustrates a graph of line ($T_{in}-T_{sat}$), which is representative of the difference between the inlet temperature $T_{in}$ of the air returning to the lower flue 46 and the saturated evaporator temperature $T_{sat}$. As the time $D_{on}$ to begin the second scheduled defrost cycle approaches, the difference between the temperatures $T_{in}$ and $T_{sat}$ increases as a result of frost accumulating on the evaporator 70. As discussed above, built-up frost on the evaporator 70 reduces the velocity of the air moving through the evaporator 70, therefore decreasing the effectiveness of the air curtain 78 and increasing the inlet temperature $T_{in}$ of the air returning to the lower flue 46. Further, the controller 106 can compare the ambient temperature, relative humidity, or dew point of the merchandiser's surroundings with similar pre-determined values to determine whether the defrost schedule should be adjusted or whether a defrost cycle should be initiated.

Rather than comparing the calculated values ($T_2-T_1$), $(T_{in}-T_{out})_2-(T_{in}-T_{out})_1$, and $(T_{in}-T_{sat})_2-(T_{in}-T_{sat})_1$ with a single pre-determined value, t he controller 106 can compare the calculated values with a range of pre-determined acceptable values. If the calculated values fall within the range of acceptable values, then no adjustments to the defrost schedule may be made.

Various features of the invention are set forth in the following claims.

The invention claimed is:

1. A method of controlling a refrigerated merchandiser, comprising:

providing a case defining a product display area and an air passage having an inlet that receives air from the product display area and an outlet that delivers air to the product display area;

positioning an evaporator in the air passage to refrigerate the air;

positioning a fan in the air passage to move the air through the passage;

logging a first temperature value during frost-free operation of the evaporator, the first temperature value associated with at least one of the air entering the inlet of the air passage, the air exiting the outlet of the air passage, and saturated evaporator temperature;

logging a second temperature value during frosted operation of the evaporator, the second temperature value associated with at least one of the air entering the inlet of the air passage, the air exiting the outlet of the air passage, and saturated evaporator temperature;

calculating a difference of the first and second temperature values; and defrosting the evaporator when the difference exceeds a pre-determined value.

2. The method of claim 1, further comprising comparing the difference of the first and second temperature values with the pre-determined value.

3. The method of claim 1, wherein logging the first and second temperature values includes logging at least one of an inlet air temperature, outlet air temperature, and saturated evaporator temperature.

4. The method of claim 1, wherein logging the first and second temperature values includes logging at least one of a difference between outlet air temperature and inlet air temperature, and a difference between saturated evaporator temperature and inlet air temperature.

5. The method of claim 1, wherein the product display area defines a highest temperature zone and a lowest temperature zone, and wherein the method further includes generating a first signal representative of the temperature of products positioned in the highest temperature zone of the product display area using a first product simulator;

generating a second signal representative of the temperature of products positioned in the lowest temperature zone of the product display area using a second product simulator; and adjusting an outlet temperature set point in response to the first and second signals generated by the first and second product simulators.

6. The method of claim 5, further comprising positioning the first product simulator adjacent to the inlet of the air passage.

7. The method of claim 5, further comprising:

providing a rear wall in the case separating in part the product display area from a vertical portion of the air passage, the rear wall having a plurality of apertures to communicate the air passage and the product display area; and positioning the second product simulator adjacent to the rear wall.

8. The method of claim 1, wherein the evaporator refrigerates the air in the air passage according to an outlet temperature set point, and wherein the method further includes detecting an outlet temperature of the air discharged from the outlet of the air passage;

calculating a temperature difference between the outlet temperature and the outlet temperature set point; and adjusting flow of refrigerant through the evaporator to decrease a magnitude of the temperature difference.

9. The method of claim 8, wherein detecting the outlet temperature of the air discharged from the outlet of the air passage occurs about every 1 to 3 seconds of operation of the refrigerated merchandiser.

* * * * *